US006325241B1

(12) United States Patent
Garde et al.

(10) Patent No.: US 6,325,241 B1
(45) Date of Patent: Dec. 4, 2001

(54) TABLET DISPENSER WITH ROTATING COVER

(75) Inventors: Kristian Garde, Rungsted Kyst; Steve McGugan, Lyngby; Peter Lykke, Aalborg, all of (DK)

(73) Assignee: Novo Nordisk A/S, Bagsvaerd (DK)

( * ) Notice: Subject to any disclaimer, the term of this patent is extended or adjusted under 35 U.S.C. 154(b) by 0 days.

(21) Appl. No.: 09/439,883

(22) Filed: Nov. 12, 1999

Related U.S. Application Data

(60) Provisional application No. 60/118,602, filed on Feb. 4, 1999.

(30) Foreign Application Priority Data

Nov. 13, 1998 (DK) ..... PA 1998 01473

(51) Int. Cl.[7] ..... B65D 1/36

(52) U.S. Cl. ..... 221/87; 221/86; 221/91; 206/533; 206/538

(58) Field of Search ..... 221/4, 5, 24, 82, 221/86, 91, 87, 120; 206/531, 532, 533, 534, 535, 536, 538, 539, 459

(56) References Cited

U.S. PATENT DOCUMENTS

| | | | | |
|---|---|---|---|---|
| 3,348,731 | * | 10/1967 | Eicholtz et al. | 206/534 |
| 3,557,747 | * | 1/1971 | Rigney et al. | 221/86 X |
| 3,722,739 | | 3/1973 | Blumberg . | |
| 3,743,085 | * | 7/1973 | Richert | 221/91 X |
| 3,895,737 | * | 7/1975 | Phillips | 221/82 |
| 4,078,661 | * | 3/1978 | Thomas | 206/533 |
| 4,555,044 | | 11/1985 | Pearo . | |
| 4,646,936 | * | 3/1987 | Frazier et al. | 221/86 X |
| 5,154,296 | * | 10/1992 | Cutler | 206/534 |
| 5,409,132 | * | 4/1995 | Kooijmans et al. | 221/86 |
| 5,664,697 | | 9/1997 | Lambelet, Jr. et al. . | |

FOREIGN PATENT DOCUMENTS

| | | |
|---|---|---|
| 0 212 464 | 3/1987 | (EP) . |
| 0 485 819 | 5/1992 | (EP) . |
| 0 578 296 | 1/1994 | (EP) . |
| 0 807 589 | 11/1997 | (EP) . |
| 998765 | 7/1965 | (GB) . |
| WO 90/13878 | 11/1990 | (WO) . |

* cited by examiner

*Primary Examiner*—Donald P. Walsh
*Assistant Examiner*—Patrick Mackey
(74) *Attorney, Agent, or Firm*—Skadden, Arps, Slate, Meagher & Flom LLP

(57) ABSTRACT

Disclosed is a tablet dispenser for consecutive administering of tablets, the dispenser having a circular container (21) in which tablets are stored in a number of compartments (24) along the perimeter of the container, and a circular lid (22) concentric with the container, which lid (24) covers the compartments (24) and has a dispensing opening allowing access to one compartment at the time when the lid is rotated relative to the container. A cylindrical surface on the container part forms a pawl wheel provided with teeth (32) each having a ramp shaped and a steep edge and the lid (22) is provided with elongated, flexible pawls (30) which are at one end fixed to the lid (22) and follows a chord of the circular device to engage the teeth (32) of the pawl wheel by its other free end.

6 Claims, 3 Drawing Sheets

TABLET DISPENSER WITH ROTATING COVER

CROSS-REFERENCES TO RELATED APPLICATIONS

This application claims priority from U.S. provisional application No. 60/118,602 filed Feb. 4, 1999 and Danish application PA 1998 01473 filed Nov. 13, 1998, the contents of which are fully incorporated herein by reference.

BACKGROUND OF THE INVENTION

1. Field of the Invention

The invention relates to tablet dispensers for consecutive administering of tablets, and specifically a dispenser comprising a circular container in which tablets are stored in compartments along the perimeter of the container, and a circular lid concentric with the container, which lid covers the compartments and has a dispensing opening allowing access to one compartment at the time when the lid is rotated relative to the container.

2. Description of the Related Art

In a known dispenser the lid is made rotatable relative to the container about a bearing formed by a cylindrical wall in the container concentric with said container, which wall forms a journal for the lid which has a central opening encompassing said cylindrical wall. The opening is along its perimeter provided with a toothing comprising teeth having a ramp shaped edge and steep edge. This toothing collaborates with protrusions in said bearing which protrusions form similar teeth having their ramp shaped edges facing the ramp shaped edges of the teeth in the opening of the lid. This way the ramp shaped edges of the teeth of the lid and the ramp shaped edged of the teeth of the protrusions will slide over each other when the lid is rotated in one direction whereas the steep edges of the two sets of teeth will engage each other and block the rotation if the lid is rotated in the opposite direction.

When the ramp shaped edges of the teeth of the lid slides over the ramp shaped edges of the teeth of the protrusions on the cylindrical wall this wall will be deformed and pressed towards its centre. The force needed to provide said deformation is large enough to make it difficult to rotate the lid even when axial slots are provided on each side of the protrusions so that the cylindrical wall is divided into more less rigid sectors. If the parts of the cylindrical wall carrying the protrusions are made weaker and more flexible their liability to flex away when rotation in the not allowed direction is attempted will increase too. If the teethes are made low to make the lid easier to rotate then the difference in force needed to rotate the lid in the allowed direction with the ramp shaped edges of the teeth sliding over each other and the force needed to force the steep edges of the teeth to cam over each other is made small too and the detent function may be destroyed.

It is an object of the invention to provide a tablet dispenser of the described circular kind in which the lid can easily be rotated in the allowed dispensing direction whereas the force needed to break the detent and rotate the lid in the opposite direction is remarkably higher.

SUMMARY OF THE INVENTION

This is obtained by a tablet dispenser for consecutive administering of tablets, and specifically a dispenser comprising a circular container in which tablets are stored in a number of compartments along the perimeter of the container, and a circular lid concentric with the container, which lid covers the compartments and has a dispensing opening allowing access to one compartment at the time when the lid is rotated relative to the container, wherein a cylindrical surface on one of the parts, the container part or the lid, forms a pawl wheel provided with teeth each having a ramp shaped and a steep edge and the other part is provided with a detent co-operating with said teeth to allow only unidirectional rotation of the parts relative to each other, which dispenser is according to the invention characterised in that the detent comprises at least one elongated, flexible pawl which is at its one end fixed to the other of said parts and mainly follows a chord of the circular device to engage the teeth of the pawl wheel by its other free end.

A pawl of the kind described is flexible when influenced by bending forces perpendicular to its longitudinal direction as it is when it slides along the ramp shaped edges of the teeth but is practically inflexible when influenced by forces in its longitudinal direction as it is when the steep edge of a tooth presses against its free end.

To ensure that the pawl has a length which allows it to be sufficiently resilient, the arc spanned by the pawl may appropriately be at least 30° and preferably about 60°.

In a preferred embodiment of the dispenser according to the invention three pawls are provide displaced about 120° from each other.

In a preferred embodiment of the dispenser according to the invention the teeth are provided at an inner surface of the ring formed by the compartments and the pawl is carried by the lid. Said inner surface makes the cylinder surface with the largest obtainable diameter and therefore allows the highest possible teeth with a given slope of the ramp shaped edges. It shall be noticed that the number of teeth corresponds to the number of compartments in the container so that one tooth is passed by the pawl each time a tablet is dispensed.

The container part with the teeth and the lid with the pawl may each be integrally moulded parts.

BRIEF DESCRIPTION OF THE DRAWINGS

In the following the invention is described in further details with references to the drawings wherein.

DETAILED DESCRIPTION OF THE INVENTION

Figure 1:
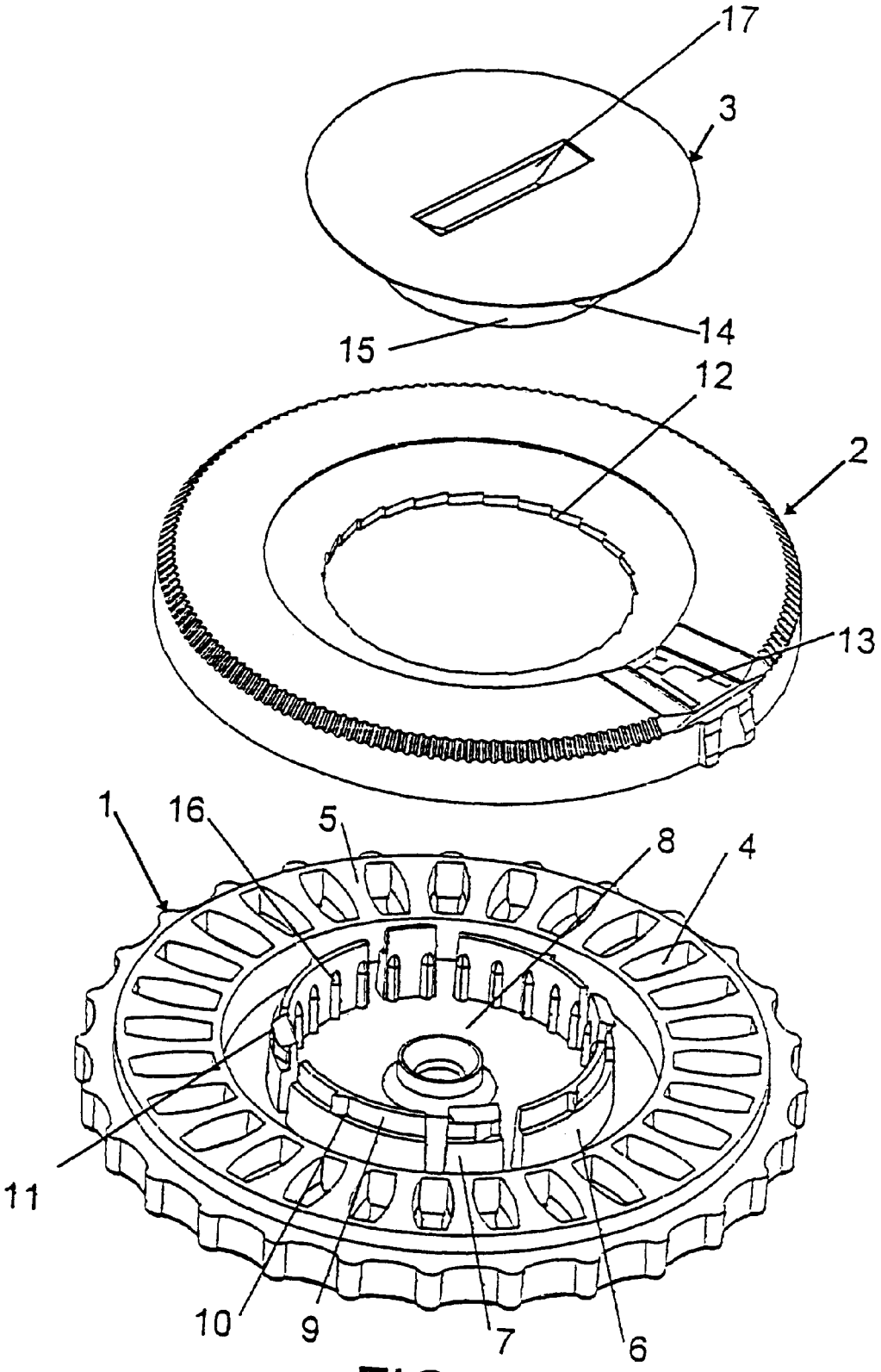
FIG. 1 shows an exploded view of a dispenser according to the known art.

The dispenser according to the known art shown in FIG. 1 comprises a mainly circular bottom part 1, a mainly circular lid part 2 and a mainly circular day indicator 3.

The bottom part 1 has a number of compartments 4 provided in a massive ring 5 forming a part of said bottom part 1. The lid part 22 has a central opening by which the lid part can be journalled on a bearing surface 9 provided in a cylindrical wall formed by a number of sections 6 and 7 erected vertically from the bottom 8 of the bottom part 1. The sections forming the cylindrical wall are of two kinds. Long sections having a protrusion 10 on their bearing surface 9 and short sections which have in addition to a protrusion 10 on their bearing surface a hook shaped upper edge 11 which keeps the lid part 22 journalled on the bearing surface 9 of the cylindrical wall when the opening is snapped over said hook shaped edges.

The lid part 2 is in its central opening, which is jounalled on the bearing surface 9 of the cylindrical wall of the bottom part 1, provided with a number of teeth 12 co-operating with the protrusions 10 of the bearing surface 9. The teeth 12 as well as the protrusions are provided with a steep and a ramp shaped edge mutually so directed that the ramp shaped edges of the teeth and the protrusions slides over each other when the lid part 2 is rotated in one direction relative to the bottom part 1 whereas the steep edges of the protrusions abut the steep edges of the teeth 12 to prevent rotation when a rotation in the opposite direction is attempted. The allowed rotation is obtained due to the fact that the sections 6 and 7 are pressed to bend towards the centre of the dispenser when the ramp shaped edges of the teeth 12 and the protrusions 10 slides over each other until the steep edge is reached an the sections jumps back with a click sound indicating that a rotation sufficient to dispense one tablet has been performed. However, the length of the sections is short and due to their arched shape the sections are rather stiff and consequently the teeth and the protrusions have to be very low. This results in a rather soft click sound when the bent sections snap back and further the force needed to make the steep edges snap past each other is limited.

When the lid part 2 is mounted on the bottom part 1 it can be rotated to successively dispense one tablet at the time through a dispensing opening which is opened when a closure 13 is broken off. The closure guarantees that the product is new and unused when purchased.

Finally a day indicator 3 can be mounted. This indicator has (not shown) sequences of the days of the week written along its perimeter so that the user who is supposed to take one tablet a day can se that she has taken the tablet of this day. The day indicator is locked in a set rotational position relative to the bottom part 1 by a protrusion 14 on a cylindrical wall 15 on the day indicator engaging the space between a pair of a number of ribs 16 provided on the inner side of the sections 6 and 7 forming the cylindrical wall of the bottom part 1. The locking between the day indicator 3 and the bottom part 1 is so firm that it can only be overcome when a tool is used to rotate the day indicator 3 relative to the bottom part 1. The tool can be a coin which is inserted in a kerb 17 in the day indicator to rotate it to a position in which the day written on the day indicator corresponding to the day when the device is taken into use is positioned aligned with the closure 13 which is then broken off to have access to the first tablet. The following days the lid is rotated to dispense the next tablet which forms a stop preventing that the lid is rotated more than one step. Now the opening will each day be aligned with a day on the day indicator corresponding to the actual day.

Figure 2:
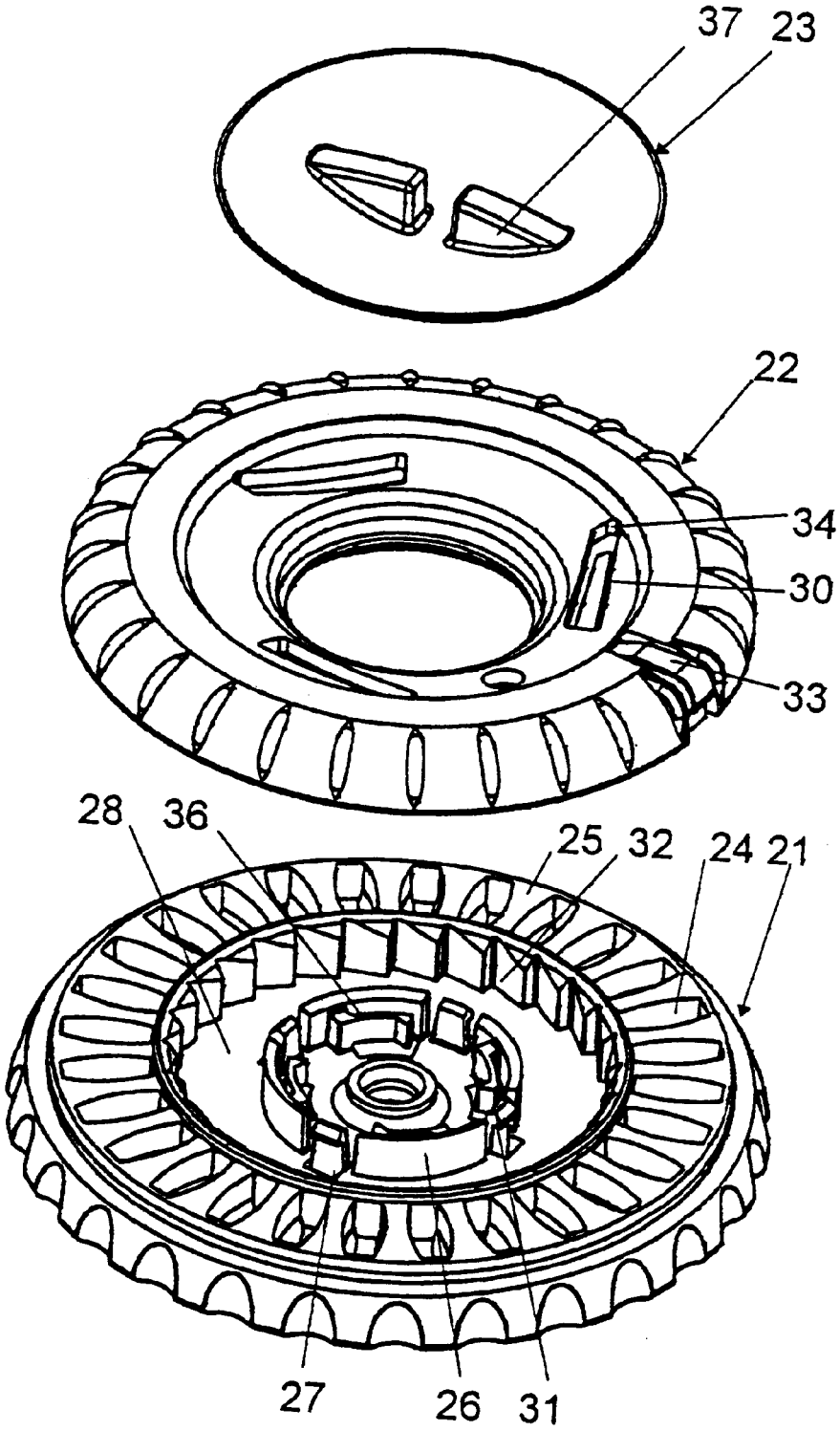
FIG. 2 shows an exploded view of a dispenser according to the invention.

FIG. 2 shows an exploded picture of a dispenser according to the invention. Also this dispenser comprises a bottom part 21, a lid part 22 and a day indicator 23.

The bottom part 21 has a number of compartments 24 provided in a massive ring 25 forming a part of said bottom part 21. The lid part 22 has a central opening by which the lid poart is journalled ona the bearing surface provided by a cylindrical wall formed by a number of alternating sections 26 and 27 erected vertically from the bottom 28 of the bottom part 21. The sections 27 have at their upper edge a hook 31 which keeps the lid part 22 journalled on the bearing surface of the cylindrical wall when the opening of said lid part is snapped over said hooks 31. The sections 26 have on their side facing the center of the cylindrical wall a flexible lock arm 36 with a protrusion 38 which can cooperate with recesses on a cylindrical wall (not shown) depending from a day indicator 23.

Figure 3:
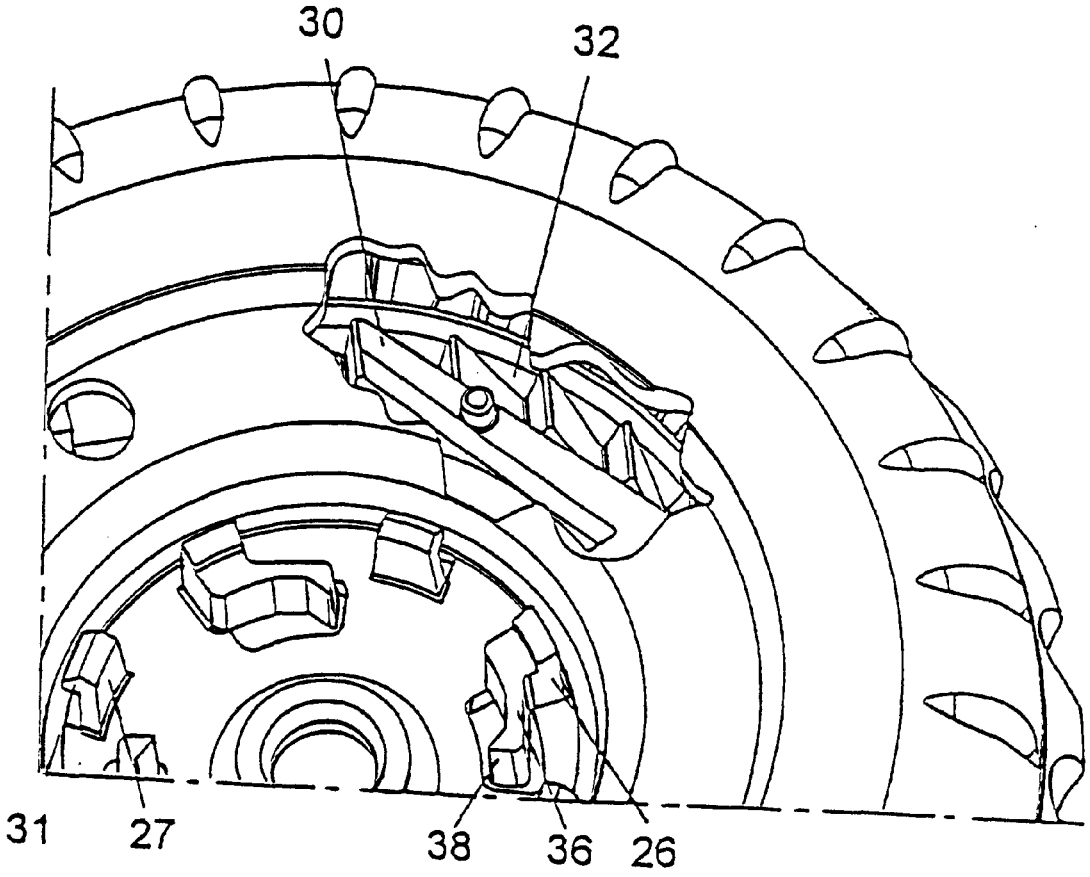
FIG. 3 shows a part of the dispenser of FIG. 2 with the lid mounted on the container part and with some of the lid broken away to reveal the engagement between one of the pawls and the pawl wheel.

The inner perimeter of the massive ring 25 is provided with pawl wheel teeth 32 having a steep and a ramp shaped edge. The pawl wheel teeth 32 co-operate with pawls 30 provided in the lid part 22 as shown in FIG. 3.

In the shown embodiment three pawls 30 are provided in the lid part 22. These pawls 30 are elongated plastic members which are at one end connected to the lid part 21 by being moulded integrally with said lid part displaced 120° relative to each other and so positioned that they follow a chord in the circular lid part and form when the lid is mounted on the bottom part 21 a chord in the circle defined by the inner pawl wheel provided by the pawl wheel teeth 32 in said bottom part 21. The pawls are so positioned that their fixed ends which are secured to the lid can just pass the top of the pawl wheel teeth of the bottom part when the lid is rotated on its bearing formed by the sections 26 and 27, whereas the free ends of the pawls 30 engage the pawl wheel teeth and allow only rotation in the direction where the free ends of the pawls can be bent away when they slide over the ramp shaped edges of the teeth until they pass the end of the ramps and jump back and hit the ramp shaped edges of the succeeding teeth with a sharp click. Rotation in the opposite direction where the free ends of the pawls abuts the steep edges of the teeth is blocked as the pawls is acted upon with forces in their longitudinal directions and consequently will be very reluctant to bend away.

In the shown embodiment the lid has slots 34 above the pawls 31. These slots are provided for moulding purposes. Further the lid has a closure 33 corresponding to the closure 13 in FIG. 1.

Also the shape and the function of the day indicator 23 corresponds to the shape and the function of the day indicator 3 in FIG. 1, only the kerb 17 in FIG. 1 is replaced by a finger grip 37 by which the day indicator can be operated to bring the relevant day of the week on the day indicator in alignment with the closure 33. Further the day indicator 23 has the depending cylindrical wall 40 with recesses 39 which can co-operate with the protrusions 38 on the resilient lock arms 36 in the bottom part 21 to maintain the day indicator in a set position, relative to the bottom part 21.

What is claimed is:

1. A tablet dispenser for consecutive administering of tablets, comprising:

a circular container part having a number of compartments along the perimeter of the container for storing tablets, and a circular lid part concentric with the container, which lid part is rotatable relative to said container, which has a dispensing opening allowing access to one compartment at a time when the lid part is rotated relative to the container, and which covers the remaining compartments, wherein one of said parts includes a pawl wheel provided with teeth, each tooth having a ramp shaped surface and a steep edge surface, and the other said part is provided with at least one elongated, flexible pawl which has one end fixed to the other said part and an opposite, free, flexible end, wherein said pawl, in a direction starting at its fixed end toward its free, flexible end, is oriented to include a directional component towards said steep edge surface and is positioned so that said free, flexible end engages the teeth of the pawl wheel.

2. The tablet dispenser according to claim 1, wherein said container part includes a cylindrical portion containing said pawl wheel teeth, and wherein said at least one pawl is oriented along a chord of said pawl wheel which spans an arc of at least 30°.

3. The tablet dispenser according to claim 2, wherein the arc spanned by said chord is about 60°.

4. The tablet dispenser according to claim 1, wherein three pawls are provided displaced about 120° from each other.

5. The tablet dispenser according to claim 1, wherein the container part includes a ring portion having an inner, generally cylindrical surface which includes the teeth of said pawl wheel and wherein said pawl is carried by the lid part.

6. The tablet dispenser according to claim 5, wherein the container part with the teeth and the lid part with the pawl each are integrally molded parts.

* * * * *